US006582591B1

(12) United States Patent
Jaubert et al.

(10) Patent No.: US 6,582,591 B1
(45) Date of Patent: Jun. 24, 2003

(54) PROCESS FOR THE TRANSPORTATION OF NAPHTHA IN A CRUDE OIL PIPELINE

(75) Inventors: Jean-Marc Jaubert, Orgeval (FR); Alain Niklaus, Marles-en-Brie (FR)

(73) Assignee: Atofina, Puteaux (FR)

( * ) Notice: Subject to any disclaimer, the term of this patent is extended or adjusted under 35 U.S.C. 154(b) by 238 days.

(21) Appl. No.: 09/634,585

(22) Filed: Aug. 8, 2000

(30) Foreign Application Priority Data

Aug. 9, 1999 (FR) ..... 99 10322

(51) Int. Cl.[7] ..... F17D 1/16
(52) U.S. Cl. ..... 208/370; 137/13; 585/899
(58) Field of Search ..... 208/370; 137/13; 585/899

(56) References Cited

U.S. PATENT DOCUMENTS

| | | | | |
|---|---|---|---|---|
| 3,209,771 A | | 10/1965 | Gogarty et al. | 137/1 |
| 4,142,542 A | * | 3/1979 | Mitchell | 137/1 |
| 5,259,250 A | * | 11/1993 | Kolpak | 73/861.38 |
| 6,096,192 A | * | 8/2000 | Myers et al. | 208/108 |
| 6,210,561 B1 | * | 4/2001 | Bradow et al. | 208/89 |

FOREIGN PATENT DOCUMENTS

DE 1 255 413 11/1967

OTHER PUBLICATIONS

XP–002135547—Batching, treating keys to moving refined products in crude–oil line, Judy S. Baum et al., Oil And Gas Journal, Oct. 5, 1998, pp. 49–55—no date.
XP–002135548—Sonic detectors see gasoline interfaces, Ellis M. Zacharias, Jr., Oil And Gas Journal, vol. 96, No. 40, Aug. 21, 1972, pp. 79–81—no date.

* cited by examiner

*Primary Examiner*—Nadine G. Norton
(74) *Attorney, Agent, or Firm*—Millen, White, Zelano & Branigan, P.C.

(57) ABSTRACT

This process for the transportation of a batch of naphtha in a pipeline, the prime purpose of which is to transport crude oil, is characterized in that the batch of naphtha, bracketed by batches of condensates, namely a head batch of condensate and a tail batch of condensate, is conveyed in the pipeline and, on arrival, the batch of naphtha is recovered between a point in time at the earliest at the end or substantially at the end of the passage of the head condensate/naphtha interface region and a point in time at the latest at the beginning or substantially at the beginning of the appearance of the naphtha/tail condensate interface region.

15 Claims, No Drawings

PROCESS FOR THE TRANSPORTATION OF NAPHTHA IN A CRUDE OIL PIPELINE

The invention relates to exhortation of naphtha in a crude oil pipeline.

Naphtha is one of the products from the refining of oil, the distillation range of which lies in the 50–180° C. region. It is predominantly composed of normal paraffins and isoparaffins and to a lesser extent of naphthenics (cycloparaffins). Olefinic and aromatic products are minor constituents of it. In schemes for the refining and upgrading of crude oil, this naphtha cut is conventionally intended:

for reforming, in which operation paraffins and naphthenics are converted into aromatics with high octane numbers suitable for use in the formulation of premium-grade gasolines;

for steam cracking, a key operation for the production of basic chemicals in which naphtha is cracked in the presence of steam at approximately 750–850° C. to yield ethylene, propylene, butadiene, butenes, benzene and other less desired products. This operation is described in detail in the book by A. Chauvel et al., Procédés de Pétrochimie, Volume 1, page 131, published by Technip (1985).

The steam cracker is composed essentially of a "cold part", in which the products resulting from the cracking reaction are separated by distillation and purified, and of a "hot part", in which the cracking reactions take place. This hot part comprises:

a convection region, in which the products are preheated from 120° C. to approximately 550° C. by recovery of the sensible heat of the furnaces;

a radiation region, in which the temperature is raised from 550° C. to 750–850° C., where the cracking proper takes place;

a quenching region, in which the temperature of the cracking products is suddenly lowered from 750–850° C. to approximately 350–400° C. by means of exchangers operating with steam.

The naphtha which feeds the steam cracker must not comprise heavy products or products which cannot be distilled, or else the convection region will rapidly become fouled or the quenching region will become coked, episodes which result in the unit being shut down for cleaning or decoking. In view of the very large size of these units (amounts of naphtha treated of greater than 1.5 million tonnes per year), such shutdowns constitute major disadvantages from an economic viewpoint.

The transportation of naphtha and more generally the transportation of refined petroleum products takes place in pipelines known as "white product pipelines". The same pipeline is used for the transportation of different products which are injected sequentially therein batchwise. A mixing region is formed at each interface between different batches, which region, on arrival, corresponds to a contaminated product known as "contaminate" which, in principle, has to be reprocessed before it is used. This contaminate represents on average 5 to 10% of the total batch conveyed in the pipeline.

Pipeline operators know of and properly control this phenomenon. Thus, in order to reduce the volumes of contaminates or to minimize the reprocessing thereof, it is possible, for example:

to avoid pumping shutdowns, which result in pipeline surges;

to rinse the pumping stations, in order to prevent the products present in the "cutoffs" from mixing with the main product;

to make batches as big as possible;

to take care that two batches which succeed one another do not have very different viscosities;

to group together batches with similar qualities, so as to minimize the reprocessing operations: thus, the contaminate between a batch of LSC (low sulphur content) fuel oil and a batch of HSC (high sulphur content) fuel oil can be allocated to the HSC fuel oil without reprocessing. Likewise, the contaminate between a batch of kerosene and a batch of gas oil will be allocated to the gas oil.

A much more complex problem to be solved is the transportation of refined products in a crude oil pipeline. Crude oil pipelines generally have larger diameters than "white product" pipelines and thus have much greater transportation capacities, generally over greater distances. The transportation of refined products in a crude oil pipeline thus takes place at a much lower cost in comparison with the cost with regard to white product pipelines. Furthermore, over certain routes, white product pipelines do not always exist and the use of a crude oil pipeline then makes it possible to save on a considerable investment. The use of crude oil pipelines for the transportation of refined products is thus a very important economic issue, which is why these pipelines are sometimes used for this purpose despite the difficult problems of contamination which have to be solved.

Thus, in order to avoid or minimize contamination at the interfaces between batches of refined products or between crude oil and refined products, it is advisable to take the precautions already listed in the description of the sequential transportation of refined products in a white product pipeline.

However, crude oil comprises highly coloured products, long-chain paraffins which can precipitate out, insoluble asphaltenes and mineral loads, all factors which, over time, result in a deposit on the walls of the pipeline. This deposit can release impurities during the passage of a batch of refined product, which constitutes a fresh source of contamination which this time affects the core of the batch. The article entitled "Batching, treating keys to moving refined products in crude-oil line" in "*Oil and Gas Journal*" of Oct. 5, 1998, page 49, gives a very good account of the whole problem and of the precautions which it is advisable to take in order to minimize the contamination at the interfaces and at the cores of the batches. In particular, the use of "scrapers", which are generally moved along in the pipeline with the crude oil in order to periodically clean the walls, is to be prohibited during the transportation of refined products, as it enhances the turbulence and increases the level of contamination in the batches.

This article shows a typical sequence of batches of refined products which can be transported in a crude oil pipeline: Crude oil—Diesel oil—Premium-grade petrol—Methyl tert-butyl ether (MTBE)—Premium-grade petrol—Aviation fuel (Jet A)—Diesel oil—Crude oil.

Once all the precautions have been taken to minimize contamination, each of the interfaces of the various batches is detected on arrival by ultrasound and colorimetry. The whole of each batch is distilled, treated over zinc oxide and conveyed to the corresponding finished product tank. The interfaces are themselves also distilled, treated over ZnO and conveyed to downrated product tanks while awaiting reprocessing.

The transportation of batches of naphtha is, however, not at all envisaged in this *Oil & Gas Journal* article.

The Applicant has now discovered that the transportation of naphtha between two batches of condensates in a crude oil pipeline makes it possible to collect, on arrival, a batch of naphtha which shows very little contamination and which is suitable for directly feeding a steam cracker without any processing and in particular without predistillation.

In contrast to the case of the transportation of the products which is described in the above-mentioned article in *Oil & Gas Journal*, where the said products are systematically redistilled on arrival in order to remove the contamination contributed by the crude oil, the Applicant has found that, surprisingly, the batches of naphtha transported between two batches of condensates did not need to be redistilled before feeding the steam cracker.

A subject-matter of the present invention is therefore a process for conveying a batch of naphtha in a pipeline, the prime purpose of which is to transport crude oil, characterized in that the said batch of naphtha, bracketed by batches of condensates, namely a head batch of condensate and a tail batch of condensate, is conveyed in the pipeline and, on arrival, the batch of naphtha is recovered between a point in time at the earliest at the end or substantially at the end of the passage of the head condensate/naphtha interface region and a point in time at the latest at the beginning or substantially at the beginning of the appearance of the naphtha/tail condensate interface region.

Condensates are liquid hydrocarbons separated from the gases by condensation. There exist two classes of them which can naturally be used in the process of the invention:

condensates which are collected at well heads in a gas field and for which the distribution of the hydrocarbons is reflected by a distillation range from approximately 30° C. to approximately 200–350° C., the final point depending on the source of the condensate under consideration; and condensates which are collected in the gases associated with the production of crude oil, also known as natural gasolines, which are on average lighter than the above and for which the distribution of the hydrocarbons is reflected by a distillation range from approximately 30° C. to approximately 100–150° C.

A detailed description of the main condensates commercially available worldwide can be found in Poten and Partners, "Condensates in World Commerce", 1993 edition.

The majority of condensates can be immediately upgraded to naphtha, kerosene and gas oil by distillation and a condensate is often characterized by its composition with regard to each of these three products. For example, it can be seen, in Poten and Partners, that the composition of the Algerian condensate HR720 (ex-Arzew) is as follows (as % by volume):

| | |
|---|---|
| $C_3$—$C_5$ Light products: | 15.6% |
| Naphtha 100–180° C.: | 35.5% |
| Kerosene 165–235° C.: | 19.7% |
| Gas oil 235–300° C.: | 12% |

The advantage represented by the use of condensates as "protective charges" for a batch of naphtha transported in a crude oil pipeline is immediately and fully seen:

1—It turned out that a batch of naphtha bracketed by two charges of condensates can be transported over nearly 1000 km in a crude oil pipeline without being significantly contaminated and thus can be used directly as steam cracking feedstock;

2—The interface regions described above as "contaminates", which represent approximately 5 to 10% of the batches, can be mixed with the condensate, which, in any case, has to be distilled in order to be upgraded;

3—The distillation for upgrading the condensates makes it possible to recover significant additional amounts of light products and of naphtha which can be used as steam cracking feedstocks.

In accordance with other characteristics of the process according to the present invention, use is made of a batch of naphtha which is as big as possible according to the available supplies; this batch must be as big as possible in order to minimize the relative proportion of the contaminates at the interfaces; in practice, this lot is generally between 9000 and 45,000 $m^3$ in size;

use is made of a head batch of condensate at least equal to 1500 $m^3$ in size, in particular at least equal to 4000 $m^3$ in size; the head batch of condensate can range up to more than 50,000 $m^3$ in size;

use is made of a tail batch of condensate at least equal to 1500 $m^3$ in size;

use is made of a head batch of condensate at least equal to the tail batch of condensate in size.

Thus, for the same amount of given condensate, it is always preferable to form a bigger head batch. Typically, when 40,000 $m^3$ of condensates are available to bracket the naphtha, 30,000 $m^3$ will commonly be taken for the head and 10,000 $m^3$ for the tail and, when the batch of condensate available is limited, for example 7000 $m^3$, it will be preferable to form a head batch of 5000 $m^3$ and a tail batch of 2000 $m^3$.

In accordance with a specific embodiment of the process of the invention:

the head batch of condensate with a given volume is injected by pumping into the crude oil pipeline, the crude oil feed of which has been halted upstream, then the batch of naphtha with a given size is injected and, finally, the tail batch of condensate with a given size is injected;

the pumping of crude oil is subsequently resumed; and, on arrival, the crude oil/head condensate interface is located;

a volume at least equal to the volume of head condensate is then collected in a condensate tank, while locating the head condensate/naphtha interface region, so as to direct the flow of the pipeline to the naphtha storage tanks at the earliest when the head condensate/naphtha interface region has been passed;

the naphtha/tail condensate interface region is located, so as to halt the flow of the pipeline to the naphtha tanks and to redirect it to the condensate storage tanks at the latest at the beginning of the appearance of the naphtha/tail condensate interface region;

a volume at least equal to the volume of tail condensate is then collected in condensate tanks, while locating the tail condensate/crude oil interface.

In accordance with preferred embodiments of the process according to the present invention:

the crude oil/head condensate and tail condensate/crude oil interfaces are located by densitometry;

the head condensate/naphtha and naphtha/tail condensate interface regions are located by densitometry and/or by colorimetry;

after the appearance of the crude oil/condensate interface, a volume equal to the known volume of head condensate injected increased by 100–1000 $m^3$ is collected in a condensate tank, then a colorimeter is brought online and the flow of the pipeline is only directed to the naphtha storage tanks when the calorimetric index reaches a set CI value corresponding to the purity desired for the naphtha;

the arrival of the naphtha/tail condensate interface is located by a densimeter situated upstream at a distance d (expressed in $m^3$), known with accuracy, from the point for receiving the batches, the flow of the pipeline to the naphtha tanks being halted in order to be directed to the condensate tanks from the appearance of this interface at the point for receiving the batches or a few hundred $m^3$ beforehand and in any case as soon as the colorimetric index CI begins to change. The distance d is obviously greater than these few hundred $m^3$.

The present invention also relates to the use of the naphtha conveyed and recovered by the process as defined above as direct feedstock for a steam cracker.

The following examples illustrate the present invention without, however, limiting the scope thereof.

EXAMPLES 1 to 9

General Procedure: Transportation of Naphtha in a Crude Oil Pipeline

The naphtha transportation tests were carried out in a crude oil pipeline with a length of 700 km and a diameter of 1.016 m (40 inches) according to the following process:

when the calorimetric index shown by the device was less than 60 on a scale drawn up in the following way:

| Colorimetric index | Pure naphtha (litres) | Crude oil Iranhy (IRH) d = 0.8704 (grams) |
|---|---|---|
| 0 | 5 | 0 |
| 30 | 5 | 1.5 |
| 60 | 5 | 3.0 |

(h) the arrival of the naphtha/tail condensate interface was located by a densimeter situated upstream at approximately 10,000 $m^3$ from the point for receiving the batches. The flow of the pipeline to the naphtha tanks was halted in order to direct it to the condensate tanks from the appearance of this interface or a few hundred $m^3$ before and in any case as soon as the calorimetric index exceeds 60;

(i) the end of the operation was detected by the appearance of the condensate/crude oil interface, located by densitometry.

The amount of naphtha recovered, which was conveyed to the steam cracker, and the amount of downrated naphtha, which is the amount of naphtha conveyed to the condensate tanks as a result of the contamination at the interfaces, have been shown in the following Table 1 for each example.

TABLE 1

| Example | Naptha transported ($m^3$) | Head condensate ($m^3$) Nature | Head condensate ($m^3$) Amount ($m^3$) | Tail condensate ($m^3$) Nature | Tail condensate ($m^3$) Amount ($m^3$) | Recovered naphtha conveyed to the Steam cracker ($m^3$) | Downrated naphtha ($m^3$) |
|---|---|---|---|---|---|---|---|
| 1 | 42,857 | Arzew | 33,398 | Arzew | 8013 | 40,637 | 2220 |
| 2 | 27,589 | Bejaia | 7031 | Bejaia | 3387 | 25,606 | 1983 |
| 3 | 38,573 | Alba | 7059 | Arzew | 2911 | 37,454 | 1119 |
| 4 | 43,370 | HVN | 18,315 | HVN | 6466 | 42,373 | 997 |
| 5 | 22,979 | Bandar | 34,923 | Bandar | 5713 | 21,770 | 1209 |
| 6 | 8976 | Bejaia | 29,945 | Bejaia | 17,021 | 7558 | 1418 |
| 7 | 43,852 | Arzew | 7211 | Arzew | 2554 | 41,549 | 2303 |
| 8 | 41,246 | Arzew | 3948 | Arzew | 2069 | 36,576 | 4670 |
| 9 | 16,266 | Bejaia | 30,983 | Bejaia | 12,974 | 14,454 | 1812 |

All the naphthas recovered were normally cracked in the steam cracker without increasing the fouling of the convection regions or abnormal coking of the quenching exchangers.

(a) a first batch of condensate, the nature and the size of which are shown for each example in Table 1 below, was injected by pumping into the crude oil pipeline, the oil feed of which was halted upstream;

(b) a batch of naphtha, the size of which is also shown in Table 1 for each example, was subsequently injected;

(c) finally, a tail batch of condensate, the size of which is also shown in Table 1 for each example, was injected;

(d) the pumping of the crude oil was resumed; and on arrival:

(e) the crude oil/head condensate interface was located by densitometry: the density of the crude oils varies between approximately 0.80 and approximately 0.87, whereas the density of the condensates is typically between approximately 0.70 and approximately 0.72;

(f) a volume of contaminate+condensate, equal to the volume of head condensate injected increased by approximately 500 $m^3$, was then collected in a condensate tank;

g) a calorimeter was then connected up and the flow of the pipeline was only directed to the naphtha storage tanks The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 99/10.322, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the transportation of a batch of naphtha in a crude oil pipeline, comprising the steps of:

(a) conveying crude oil feed in said crude oil pipeline;

(b) conveying upstream of said crude oil in said crude oil pipeline, a head condensate;

(c) conveying a batch of naphtha, in said crude oil pipeline, upstream of said head condensate, forming a head condensate/naphtha interface region;

(d) conveying a tail gas condensate, in said crude oil pipeline upstream of said naphtha, forming a naphtha/tail gas interface region;

(e) conveying a crude oil feed in said crude oil pipeline upstream of said tail condensate;

(f) on arrival at a recovery site, locating the head, gas/naphtha condensate interface region, and thereafter recovering the upstream batch of naphtha.

2. A process according to claim 1, wherein said head and tail condensates comprise at least one of:

condensates collected at well heads in a gas field and having a distillation range from approximately 30° C. to approximately 200–350° C.; and condensates collected in the gases associated with crude oil recovery and having a distillation range from approximately 30° C. to approximately 100–150° C.

3. A process according to claim 1, wherein the head condensate is at least equal to 1500 $m^3$ in size.

4. A process according to claim 1, wherein the tail condensate is at least equal to 1500 $m^3$ in size.

5. A process according to claim 1, wherein the head condensate is at least equal to the tail condensate in size.

6. A process according to claim 1 comprising halting the crude oil feed in step (a):

pumping the head condensate of a given volume into the crude oil pipeline to form a crude oil/head condensate interface region, injecting the batch of naphtha into the crude oil pipeline, injecting the tail condensate of a given volume into the crude oil pipeline;

resuming pumping of crude oil; and, locating the crude oil/head condensate interface region;

on arrival at the recovery site collecting a volume of the pipeline contents at a point upstream of said crude oil/head condensate interface region, wherein the volume is at least equal to the volume of the head condensate, in a condensate tank while locating the head condensate naphtha interface region, and then directing the flow of the pipeline to naphtha storage tanks;

locating the naphtha/tail condensate interface region, halting flow of the pipeline to the naphtha tanks and redirecting said flow to condensate storage tanks at the latest at the beginning of the appearance of the naphtha/tail condensate interface region;

collecting a volume of the pipeline contents at least equal to the volume of tail condensate in condensate tanks, after locating the tail condensate/crude oil interface region.

7. A process according to claim 6, comprising determining the crude oil/head condensate and tail condensate/crude oil interface regions by densitometry.

8. A process according to claim 6, comprising determining the head condensate/naphtha and naphtha/tail condensate interface by densitometry and/or colorimetry.

9. A process according to claim 6, wherein after the appearance of the crude oil/condensate interface region, collecting a volume equal to the known volume of head condensate injected increased by 100–1000 $m^3$ in a condensate tank, determining by colorimetry a colorimetric index of the flow of the pipeline, and directing the flow to the naphtha storage tanks when the colorimetric index reaches a set CI value corresponding to the purity desired for the naphtha.

10. A process according to claim 6, comprising locating the naphtha/tail condensate interface by a calorimeter from the appearance of the interface region and at least as soon as the calorimetric index CI begins to change, halting the flow of the pipeline to the naphtha tanks and directing the flow to the condensate tanks.

11. A method for steam cracking comprising feeding naphtha conveyed and recovered according to the process of claim 1, directly as a feedstock into a steam cracker.

12. A process according to claim 1, wherein the head condensate is at least equal to 4000 $m^3$ in size.

13. A process according to claim 6, wherein said head and tail condensates comprise at least one of:

condensates collected at well heads in a gas field and having a distillation range from approximately 30° C. to approximately 200–350° C.; and condensates collected in the gases associated with crude oil recovery and having a distillation range from approximately 30° C. to approximately 100–150° C.

14. A process according to claim 9, comprising locating the naphtha/tail condensate interface by a colorimeter from the appearance of the interface region and at least as soon as the colorimetric index CI begins to change, halting the flow of the pipeline to the naphtha tanks and directing flow to the condensate tanks.

15. A process according to claim 14, wherein said head and tail condensates comprise at least one of:

condensates collected at well heads in a gas field and having a distillation range from approximately 30° C. to approximately 200–350° C.; and condensates collected in the gases associated with crude oil recovery and having a distillation range from approximately 30° C. to approximately 100–150° C.

* * * * *

UNITED STATES PATENT AND TRADEMARK OFFICE

CERTIFICATE OF CORRECTION

PATENT NO. : 6,582,591 B1
DATED : June 24, 2003
INVENTOR(S) : Jean-Marc Jaubert et al.

It is certified that error appears in the above-identified patent and that said Letters Patent is hereby corrected as shown below:

Column 7,
Line 9, reads “head, gas/” should read -- head gas --
Line 10, reads “naphtha condensate” should read -- condensate/naptha --

Column 8,
Line 18, reads “a calorimeter” should read -- a colorimeter --
Line 20, reads “calorimetric index” should read -- colorimetric index --

Signed and Sealed this

Twentieth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,582,591 B1
DATED : June 24, 2003
INVENTOR(S) : Jean-Marc Jaubert, et al.

It is certified that error appears in the above-identified patent and that said Letters Patent is hereby corrected as shown below:

Column 1,
Line 4, reads “exhortation” should read -- transportation --

Signed and Sealed this

Fourteenth Day of September, 2004

JON W. DUDAS
*Director of the United States Patent and Trademark Office*